US009200486B2

(12) United States Patent
Leveau et al.

(10) Patent No.: US 9,200,486 B2
(45) Date of Patent: Dec. 1, 2015

(54) WIRED DRILL PIPE WITH IMPROVED CONFIGURATION

(75) Inventors: Gérard Leveau, Saint Aibin le Guichard (FR); Gabriel Roussie, Valenciennes (FR); Didier David, Ruesnes (FR)

(73) Assignee: VALLOUREC DRILLING PRODUCTS FRANCE, Cosne Cours sur Loire (FR)

( * ) Notice: Subject to any disclaimer, the term of this patent is extended or adjusted under 35 U.S.C. 154(b) by 1068 days.

(21) Appl. No.: 13/259,735

(22) PCT Filed: Mar. 4, 2010

(86) PCT No.: PCT/EP2010/001338

§ 371 (c)(1),
(2), (4) Date: Dec. 30, 2011

(87) PCT Pub. No.: WO2010/115492

PCT Pub. Date: Oct. 14, 2010

(65) Prior Publication Data

US 2012/0111555 A1 May 10, 2012

(30) Foreign Application Priority Data

Mar. 30, 2009 (EP) ..... 09290230

(51) Int. Cl.
*E21B 47/12* (2012.01)
*E21B 17/00* (2006.01)
*E21B 17/02* (2006.01)

(52) U.S. Cl.
CPC ..... *E21B 17/003* (2013.01); *E21B 17/028* (2013.01)

(58) Field of Classification Search
CPC ..... E21B 17/028; E21B 47/12; E21B 17/003; F16L 25/01
See application file for complete search history.

(56) References Cited

U.S. PATENT DOCUMENTS 3,824,686 A * 7/1974 Forney, Jr. ..... 29/828
4,095,865 A 6/1978 Denison et al.

(Continued)

FOREIGN PATENT DOCUMENTS

CN 1880721 A 12/2006

OTHER PUBLICATIONS

U.S. Appl. No. 13/821,462, filed Mar. 7, 2013, Chabas et al.

(Continued)

*Primary Examiner* — Shane Bomar
*Assistant Examiner* — Kipp Wallace
(74) *Attorney, Agent, or Firm* — Oblon, McClelland, Maier & Neustadt, L.L.P.

(57) ABSTRACT

A drill string element including a main pipe with connection ends and a protective mechanism for at least one wire. The protective mechanism extends within a central bore of the main pipe. The main pipe presents a first hole in one of the connection ends and a second hole in the other connection end, both holes communicating with the central bore. The protective mechanism includes a guide tube arranged for housing the wire, both ends of which being respectively disposed within the first hole and the second hole. A retaining mechanism is arranged in at least one of the first hole and the second hole for the respective end of the guide tube. The retaining mechanism is configured to prevent the respective end of the guide tube from moving relative to the one of the first hole and the second hole according to at least one longitudinal direction of the hole.

24 Claims, 7 Drawing Sheets

(56) References Cited

U.S. PATENT DOCUMENTS

| | | | | |
|---|---|---|---|---|
| 6,830,467 | B2 | 12/2004 | Hall et al. | |
| 7,017,667 | B2 | 3/2006 | Hall et al. | |
| 7,080,998 | B2 | 7/2006 | Hall et al. | |
| 8,344,905 | B2 | 1/2013 | Madhavan et al. | |
| 2004/0149471 | A1* | 8/2004 | Hall et al. | 174/21 R |
| 2004/0244964 | A1 | 12/2004 | Hall et al. | |
| 2005/0092499 | A1 | 5/2005 | Hall et al. | |
| 2005/0173128 | A1* | 8/2005 | Hall et al. | 166/380 |
| 2006/0225926 | A1 | 10/2006 | Madhavan et al. | |
| 2011/0290475 | A1 | 12/2011 | David et al. | |

OTHER PUBLICATIONS

U.S. Appl. No. 13/822,136, filed Mar. 11, 2013, Chabas et al.

International Search Report Issued Jan. 24, 2011 in PCT/EP10/001338 filed Mar. 4, 2010.

* cited by examiner

Fig.3
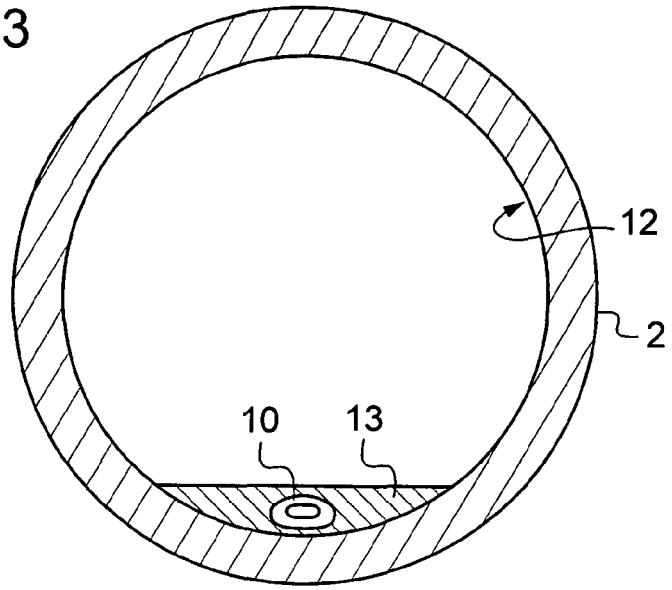
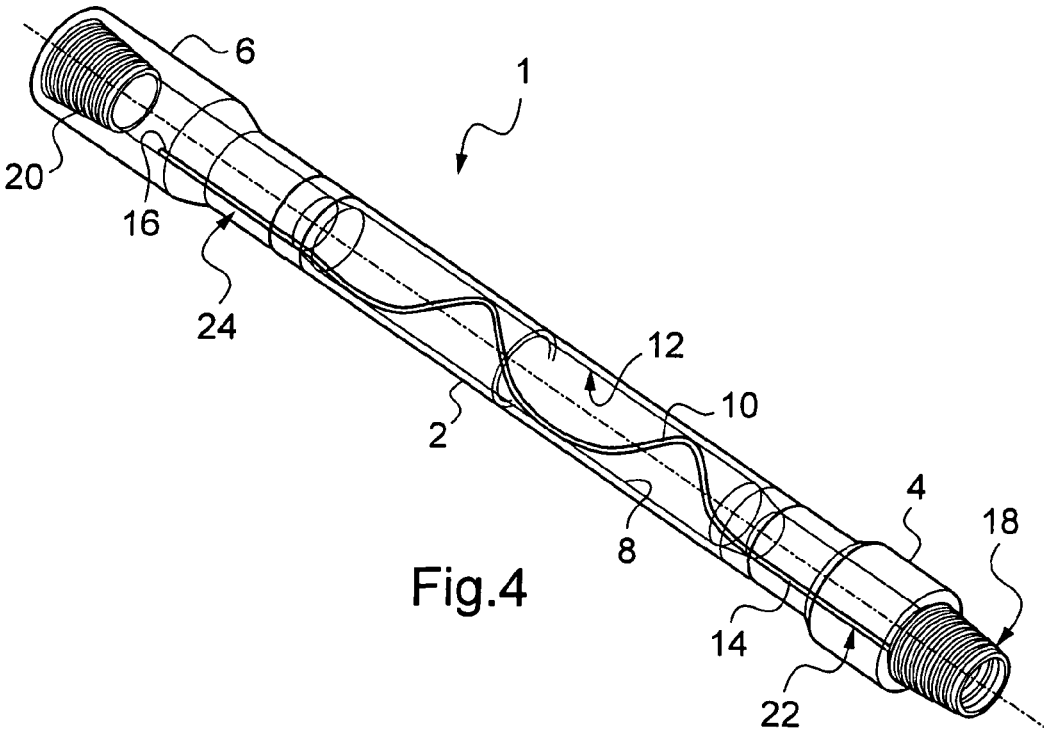
Fig.4

Fig.17
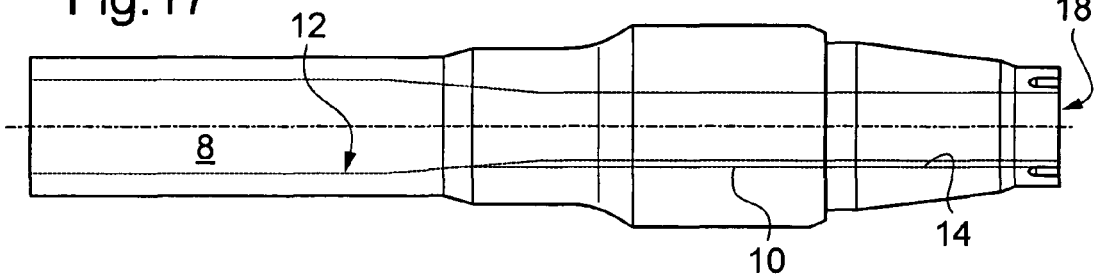
Fig.18
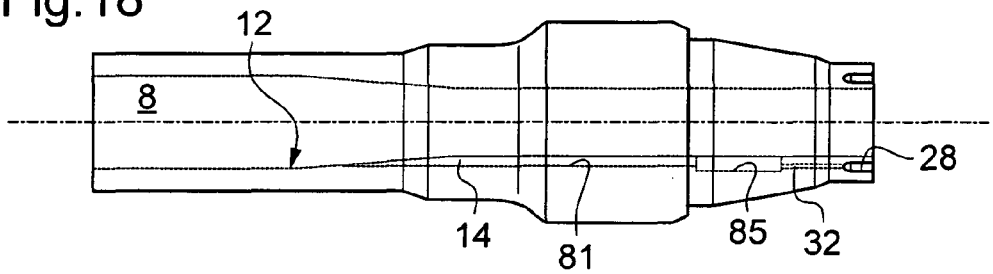
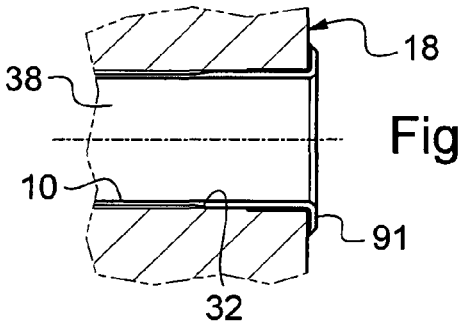
Fig.19
Fig.20
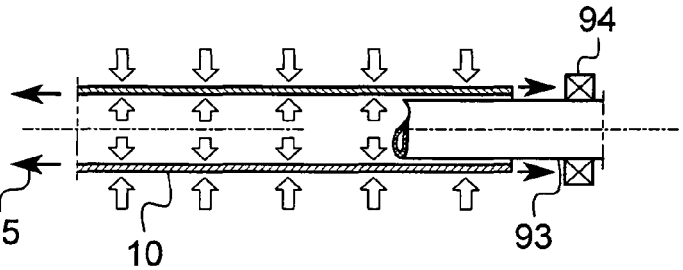
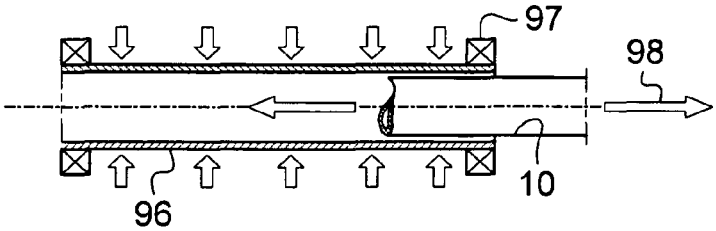
Fig.21

WIRED DRILL PIPE WITH IMPROVED CONFIGURATION

The invention relates to oil and gas drilling, and more particularly to drill pipes that are provided with devices and tools for transmitting information along downhole drilling strings.

In the downhole drilling industry, a drill rig is used to support downhole tools so as to drill bore hole into the earth. Several downhole tools form at least a portion of drill string.

In operation, a drilling fluid is typically supplied under pressure at the drill rig through the drill string. The drill string can be rotated by the drill rig to rotate a drill bit mounted at the lower end of the drill string.

The pressurized drilling fluid is circulated towards the lower end of the drill string in a bore thereof and back towards the surface outside the drill string to provide the flushing action to carry the drilled earth cuttings to the surface.

Rotation of the drill bit may alternately be provided by others downhole tools such as drill motors or drill turbines located adjacent to the drill bite.

Other downhole tools include drill pipe and downhole instrumentation such as logging while drilling tools and sensor packages. Other useful downhole tools include stabilizers, hole openers, drill collars, heavy weight drill pipe, sub-assemblies, under-reamers, rotary steerable systems, drilling jars and drilling shock absorbers, which are well known in the drilling industry.

In the downhole drilling industry, various sensors are used to take a number of measurements such as downhole geological formations, status of downhole tools or operational conditions for example.

The measurement data are useful for operators and engineers located at the surface. The measurements may be taken at various points along the drilling string. The measurement data may be used to determine drilling parameters, such as the drilling direction, penetration speed, and the like, to accurately tap into an oil, gas or other mineral bearing reservoir.

The measurement data should be transmitted to the earth surface.

Measurement while drilling (MWD) and logging while drilling (LWD) systems should provide real time information on conditions near the drill bit. Real time information helps making decisions during the drilling process.

An old industry standard for data transmission between a downhole and surface location is mud-pulse telemetry, wherein the drill string is used to convey modulated acoustic waves in the drilling string. The rate of such a data transmission is generally lower than 10 bits/second.

It is also known to store data collected by MWD/LWD systems in a downhole memory. Collected data can be downloaded from the downhole memory at the end of a bit run. This delay reduces the value of the collected data since these data do not provide real time information. There also exists a significant risk of data loss, because the memory may be damaged in the bore hole and the MWD/LWD tool may be lost in the bore hole.

Because traditional methods of transmission have very low data rates and are unsafe, it has been proposed, at the end of the twentieth century, to route a wire in interconnected drill pipe joints. Current coupled inductive couplers can be used in wired drill pipe. The couplers can be mounted proximate the sealing faces of drill pipes. Other publications concern particular solutions for data transmission along the axial length of a downhole pipe joint.

US 2006/0225926 describes a system for transmitting signals, more particularly a drill pipe adapted for conveying data between one or more downhole location within a bore hole and the surface However, a drill pipe element equipped with a transmission wire line is highly sensitive to stress, wear, vibrations and abrasion within the bore hole. In operation, the drill pipe may be bent, axially compressed and/or extended. Further, in operation, the drill pipe is crossed by drilling mud under pressure, the mud pressure being a function of mud density and of mud height above.

U.S. Pat. No. 6,717,501 discloses a straight tubular sheath for protecting a coaxial wire within the central bore of the drill pipe element. Said sheath is made of organic material such as PEEK and is attached to the central bore by a polymer. This straight tubular sheath only provides a low resistance to mechanical loads to the wires. In other cases a sheath is provided which extends helically along the central bore, as disclosed in U.S. Pat. No. 7,017,667.

US 2006/0225926 discloses a metallic sheath arranged against the inner surface of the drill element. Wires are enclosed between said sheath and the inner surface of the drill element. The use of such a sheath involves implementation of costly hydroforming equipment. Furthermore, the sheath ends does not insure a seal to the pressurized mud under service loads.

The sheath protects the optical or electrical wires, particularly within the central bore, against wear and abrasion. But, the sheath, as it, is almost inefficient in protecting the wire from stress and vibrations, particularly as sheath is made of an organic material such as PEER. Furthermore, the sheath itself may be damaged by stress and vibrations.

It is an aim of the invention to provide an improved wired drill string element, in view of the foregoing.

An object of this invention is drill string element comprising a main pipe with connection ends and protective means for at least one wire, said protective means extending within a central bore of the main pipe, the main pipe presenting a first hole in one of said connection ends and a second hole in the other connection end, both holes communicating with the central bore, wherein the protective means comprises a guide tube arranged for housing said wire, both ends of the guide tube being respectively disposed within the first hole and the second hole, retaining means being arranged in at least one of the first hole and the second hole for the respective end of the guide tube, and said retaining means being designed so as to prevent said respective end of the guide tube from moving relative to said one of the first hole and the second hole according to at least one longitudinal direction of said hole.

The applicant has designed a wired drill element which comprises a main pipe with connection ends and a guide tube intended to house at least one optical or electrical wire. The guide tube extends within a central bore of the main pipe from a first hole in one of said connection ends to a second hole in the other connection end. The guide tube can be made of metal. Thanks to the retaining means, the guide tube can be prestressed in longitudinal tension or compression with beneficial effects.

Such a retained guide tube also prevents displacement of the guide tube ends under the loads undergone by the drill pipe and thus prevents damage to couplers arranged at connection ends for transmitting electrical and/or optical information from one drill pipe to an adjacent drill pipe.

The retaining means may be arranged so as to prevent the guide tube from moving in both longitudinal directions of said hole.

The retaining means may include at least one abutment surface for the guide tube. The abutment surface typically extends radially, with respect to the axis of the pipe, in the corresponding first or second hole. The abutment surface may be a shoulder surface of the hole or an end surface of an additional member, such as a stopping member, located within the hole. Fixing means may be provided in the hole to prevent the additional member from any longitudinal displacement relative to the hole. The fixing means may include friction coupling between an outer surface of the additional member and an inner surface of the hole. The friction coupling may be obtained through a diameter expansion of the additional member. Fixing means for the guide tube, such as a mechanical retainer (e.g. a screw/nut retainer cooperating with one longitudinal end of the guide tube), may be provided within the hollowing, which may be in the form of a pocket.

The first or second hole may terminate in a bottom surface of an annular groove intended to receive a corresponding annular element (which may be a conductive layer) of a coupling device for transmitting signals to another drill string element. The additional member may be arranged as a fixing element for the corresponding annular element that passes through an opening in the annular element.

In an embodiment, the abutment surface may cooperate with an end surface of the guide tube so as to act as a retaining means, the end surface typically being radial with respect to the axis of the pipe.

In another embodiment, the abutment surface cooperates with a radially expanded portion of the guide tube so as to act as a retaining means.

In an alternative embodiment, the abutment surface, which may be in the form of an annular seat surface, is an internal surface of an additional member, such as an annular ring, through which the guide tube passes. This additional member is typically located within an internal hollowing, such as a pocket, which is open on the central bore, and the hole may pass through or terminate in the internal hollowing.

The retaining means may comprise at least one retaining portion of the hole in form of a longitudinal portion of this hole having cross-sectional dimensions larger than a main portion of the hole. The retaining portion may cooperate with a radially expanded portion of the guide tube. In a possible embodiment, the retaining portion optionally includes at least one hollowing, such as a radial groove, which is open on the central bore and has a depth larger than the diameter of the main portion of the hole. The hollowing may be filled with metallic or synthetic material.

In a possible embodiment, the retaining means may comprise a friction coupling arranged between the inner surface of a longitudinal portion of the hole and the outer surface of a longitudinal portion of the guide tube.

The retaining means may create a seal between the guide tube and the corresponding connection end.

In a possible embodiment, the hole may include a longitudinal portion which is formed as a longitudinal groove open on the internal surface of the central bore.

In a possible embodiment, the hole may terminate on a terminal face of the corresponding connection end and the guide tube may present a longitudinal terminal portion which is designed as a flange abutting on said terminal face.

In a possible embodiment, the guide tube may house an additional guide tube housing said at least one wire and may comprise communication means for mud between guide tube outer and inner peripheral surfaces. The additional guide tube is typically arranged in such a manner that it is free to move with respect to the guide tube in the longitudinal direction thereof.

In an alternative embodiment, the guide tube may be housed in a tubular sheath which is sealed to the connection ends and arranged in such a manner that it is free to move with respect to said connection ends.

Such a drill string element can be designed as a drill pipe, heavy drill pipe or drill collar, for example.

The invention also relates to such a drill string element comprising a guide tube.

The invention will be better understood and will become fully apparent from the following description, and drawings. These drawings depict only typical non-limitative embodiments.

FIG. 3 is a cross sectional view showing an alternative embodiment of the wired drill pipe of FIG. 1.

FIG. 4 is a perspective view showing an alternative embodiment of the wired drill pipe of FIG. 1.

FIG. 17 is analog to FIG. 9 according to a tenth embodiment.

FIG. 18 is analog to FIG. 9 according to an eleventh embodiment.

FIG. 19 is analog to FIG. 9 according to a twelfth embodiment.

FIG. 20 is a partial and sectional view of a guide tube according to a further development of the invention.

FIG. 21 is an alternative embodiment to FIG. 20.

It will be readily understood that the components as general described and illustrated in the figures herein, could be arranged and designed in a wide variety of different configurations. The following more detailed description of devices of the present invention, as represented in the figures, is not intended to limit the scope of the invention as claimed, but is merely representative of various selected embodiments of the invention and may optionally serve as a contribution of the definition of the invention.

Figure 1:
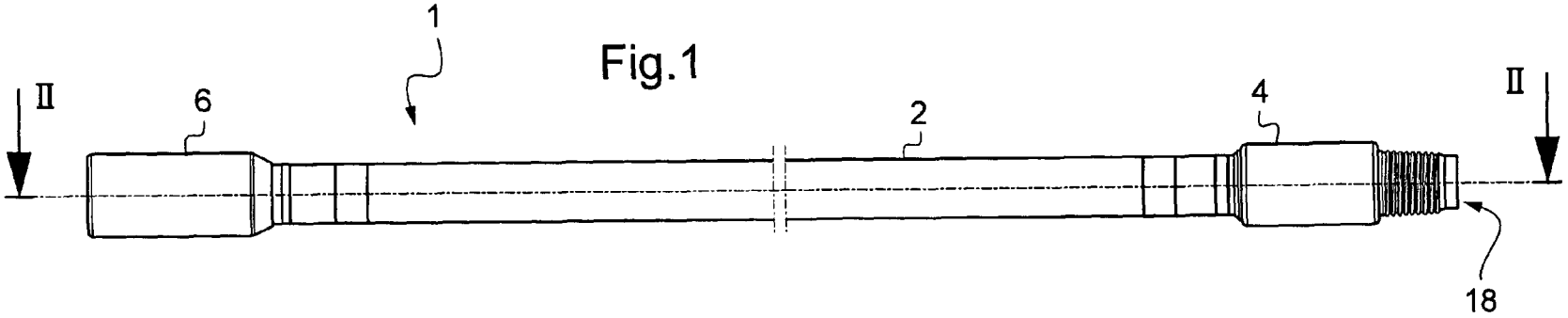
FIG. 1 is a plan view of a wired drill pipe.
Figure 2:
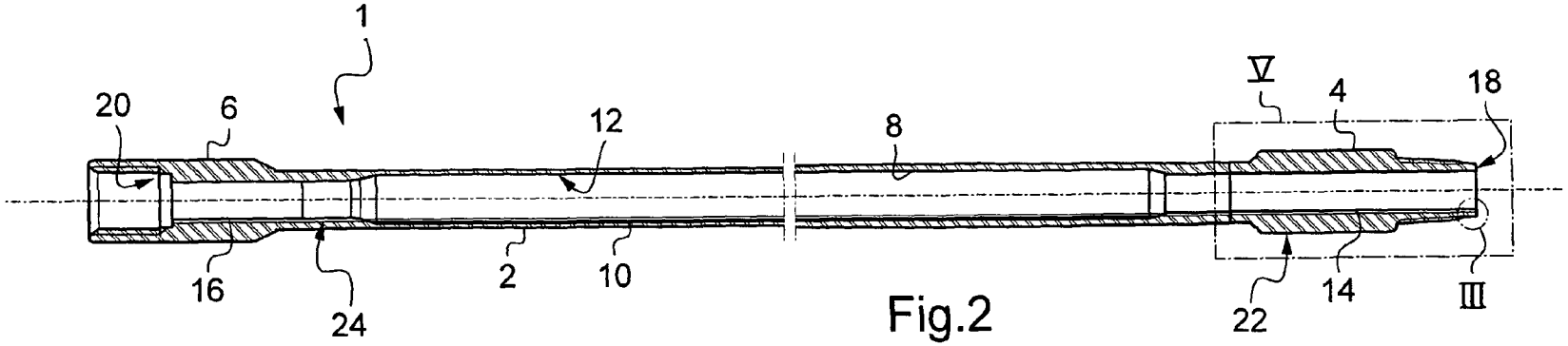
FIG. 2 is a sectional view of the wired drill pipe shown in FIG. 1, taken along a line II-II.

FIGS. 1 and 2 show a wired drill pipe 1 comprising an elongated main pipe 2. At its both ends, the elongated main pipe 2 respectively presents a first connection part 4 and a second connection part 6 for connecting adjacent drill pipes in the drill string.

US 2006/0225926 describes a drilling rig and drilling string. The content of US 2006/0225926, and more particularly the description of the drilling rig and the drilling string, is incorporated therein by reference.

Here, the first connection part 4 and the second connection part 6 are configured as complementary parts, i.e. the first connection part 4 is adapted for connection with the second connection part 6 of a similar and adjacent wired drill pipe 1 in the drill string, and vice versa.

Both the first connection part 4 and the second connection part 6 are respectively provided with an inductive coupler for data transmission from one wired drill pipe 1 to an adjacent drill pipe 1 in the drill string. For example, U.S. Pat. No. 6,641,434, U.S. Pat. No. 6,670,880 and U.S. Pat. No. 4,605,268 describe an inductive coupler in a wired drill joint.

The content of U.S. Pat. No. 6,641,434, U.S. Pat. No. 6,670,880 and U.S. Pat. No. 4,605,268, and more particularly the description of said inductive coupler, is incorporated therein by reference.

The first connection part 4 and the second connection part 6 are also known as the "tool joints" of the drill pipe 1.

The main pipe 2 has a central bore 8, which longitudinally extends from one end of the main pipe 2 to the other end thereof.

The drill pipe 1 is provided with a guide tube 10, or conduit, in form of an elongated and hollow member which mainly extends within the central bore 8, from the first connection part 4 to the second connection part 6. Here, the guide tube is made of metal, but other materials may also be suitable. The guide tube 10 is supple.

The guide tube 10 is intended to freely house one or more electric wires or cables. For example, such wires or cable could be used for connecting the inductive couplers, which are arranged at both end of the drill pipe 1.

Here, the guide tube 10 rests in contact with the internal surface 12 of the central bore 8, whereby the guide tube 10 is protected from any damaging effect of the drilling fluids flowing through the central bore 8.

The guide tube 10 could be bonded on the inner surface 12 of the central bore 8, for example by welding or adhesively bonding.

The guide tube 10 itself could also be protected from the drilling fluids (drilling mud) under pressure, or other substances or objects, passing through the central bore 8.

FIG. 3 shows that the guide tube 10 may be embedded in a protective layer 13 provided on the inner surface 12 of the central bore 8. The protective layer 13 is made of a protective material, like an epoxy resin for example.

In the embodiment of FIGS. 1 and 2, the guide tube 10 extends substantially straightly in the central bore 8.

FIG. 4 shows that the guide tube 10 could alternatively be formed according to any particular shape. Here, the guide tube 10 extends in a helix, or spiral, pattern thereby improving its reliability against bending, tensile or compression loads during drilling operations. More details about such a disposition can be found in U.S. Pat. No. 7,017,667 or in the French patent application 08/05376 filed on Sep. 30, 2008 in the name of the present Applicant.

The first connection part 4 and the second connection part 6 respectively present a first hole 14 and a second hole 16, which are arranged through the wall of the main tube 2.

The first hole 14 connects the central bore 8 to a first terminal face 18 of the drill pipe 1, which is located near the corresponding end of the central bore 8. In other words, the first hole 14 terminates inside the central bore 8 at one end, and on the first terminal face 18 at the other end.

The second hole 16 connects the central bore 8 to a second terminal face 20 of the drill pipe 1, which is located near the corresponding end of the central bore 8. The second terminal face 20 is located at a median position of the second connection part 6.

The guide tube 10 is partially housed in both the first hole 14 and the second hole 16. That is, the internal diameter of the first hole 14 (resp. second hole 16) corresponds, at least partially, to the external diameter of a first end portion 22 (resp. second end portion 24) of the guide tube 10.

By "corresponding diameter", it is to understand that the internal diameter of the first hole 14 for example is sufficient to enable the first end portion 22 of the guide tube 10 to be freely passed through the first hole 14.

Here, the guide tube 10 has an external diameter which is substantially the same over its entire length. This constant external diameter will be designated as "nominal external diameter" of the guide tube 10.

Each of the first hole 14 and the second hole 16 generally extends in a longitudinal manner with respect to the main tube 2. Here, each of the first hole 14 and the second hole presents a longitudinal axis which is substantially parallel to the longitudinal axis of the main tube 2.

Figure 5:
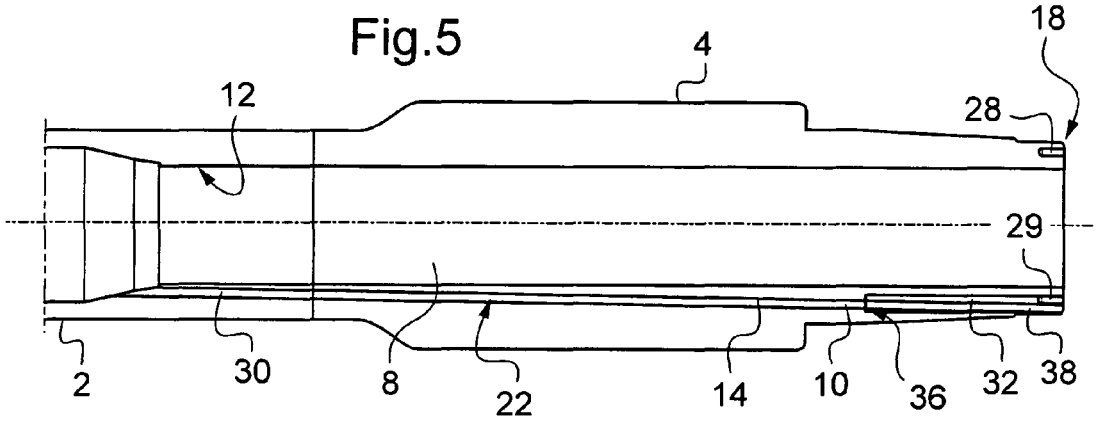
FIG. 5 is a longitudinal sectional view showing a part V of the wired drill pipe of FIG. 1, according to a first embodiment.

FIG. 5 is a detailed view of the first connection part 4 according to a first embodiment of the invention.

The first terminal face 18 of the drill pipe 1 presents an annular groove 28 which extends coaxially with respect to the longitudinal axis of the central bore 8 and is open on said first terminal face 18.

This annular groove 28 may be intended to receive an annular layer 29 of highly conductive material and an annular coil, for example as disclosed in U.S. Pat. No. 6,641,454 to be used for data transmission between adjacent drill pipes as disclosed in U.S. Pat. No. 6,641,434 or in U.S. Pat. No. 4,605,268. Here, the conductive layer presents a "U" form cross-section. Alternatively the annular groove 28 may be intended to receive a U-shaped magnetically conductive electrically insulating (MCEI) trough and a conductive coil for the same purpose as disclosed in U.S. Pat. No. 6,670,880.

The first hole 14 presents a main portion 30, which terminates into the central bore 8, and a terminal portion 32, which terminates on the first terminal face 18 and is adjacent to the main portion 30. The terminal portion 32 can also be considered as an additional hole extending the first hole 14.

The longitudinal axis of the first hole 14 is excentered with respect to the annular groove 28. The terminal portion 32 of the first hole 14 intersects the annular groove 28.

The main portion 30 of the first hole 14 presents an internal diameter which is slightly larger than the nominal external diameter of the guide tube 10. Thus, the guide tube can freely move inside the main portion 30, whereby the guide tube 10 can be easily introduced in the first hole 14.

Alternatively, the first hole 14 presents an internal diameter corresponding to the nominal external diameter of the guide tube 10 substantially over its entire length.

The terminal portion 32 of the first hole 14 presents a diameter that is lower than the width of the annular groove 28 or of the gap between both branches of the "U" of the conductive layer 29 if such a layer 29 is provided.

The terminal portion 32 of the first hole 14 also presents an internal diameter larger than the internal diameter of the main portion 30, at least near the terminal portion, so that a shoulder surface 36 is formed at the interface between the main portion 30 and the terminal portion 32 of the first hole 14.

The portion of the guide tube 10 that corresponds to the terminal portion 32, i.e. a terminal portion 38 of the guide tube 10, presents an external diameter larger than the nominal diameter of the guide tube 10. The shoulder surface 36 acts as an abutment surface for the terminal portion 38 of the guide tube 10. The guide tube 10 is prevented from moving in the longitudinal direction, towards the central bore 8.

The terminal portion 32 of the first hole 14 acts here as a retaining portion, allowing to longitudinally prestress in tension the guide tube. Prestressing a straight guide tube in tension is useful to prevent the guide tube to buckle if the generating line of the drill pipe along which the guide tube is laid undergoes compression. Buckling is particularly detrimental when the guide tube is not attached to the surface of the central bore in the central portion of the drill pipe: the guide tube may then protrude within the central bore, increase mud pressure drop and be damaged by tools traveling down the drill string.

Here, the terminal portion 38 of the guide tube 10 is designed as an expansion portion of the guide tube 10 with respect of the nominal external diameter of the latter.

The guide tube 10 may be inserted into the first hole 14, from the first terminal face 18 or from central bore 8, with its nominal external diameter. Then, the terminal portion 38 of the guide tube 10 can be radially and plastically expanded. Such diametric expansion can be manufactured using a tube expander, or by dudgeonning.

Figure 6:
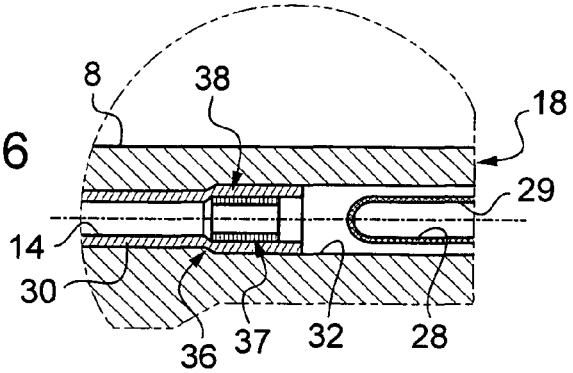
FIG. 6 is analog to FIG. 5, according to an alternative embodiment.

As shown in FIG. 6, a fixing element 37 can be introduced in the terminal part 38 of the guide tube 10 in order to both expand the terminal part 38 and maintain a contact pressure between the outer periphery of the terminal part 38 and the inner surface of the terminal part 32 of the first hole 14. An exemplary fixing element 37 presents a hollow and cylindrical shape.

It should be noted that the use of a guide tube is particularly beneficial in that it can be easily expanded by tools displaced inside and actuated at a particular location.

Figure 7:
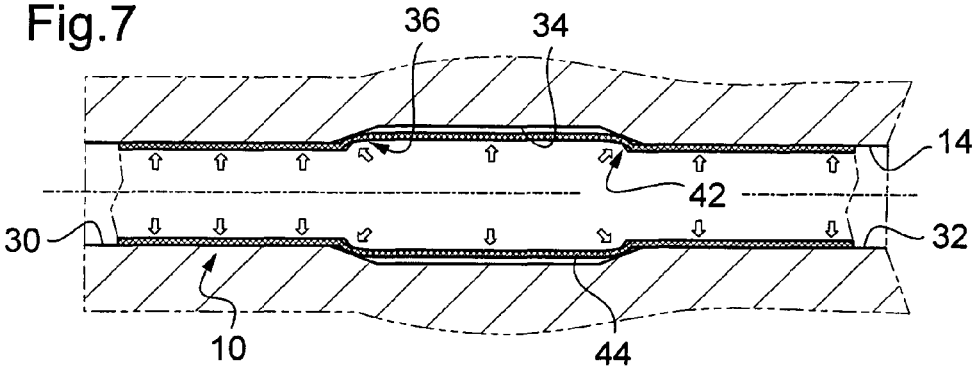
FIGS. 7 and 8 are a longitudinal sectional views partially showing the connection part of FIG. 5, according to a second embodiment.
Figure 8:
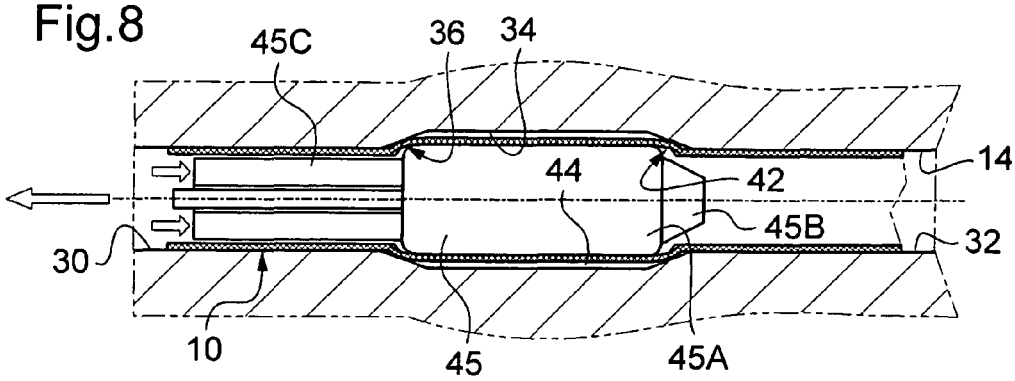

FIGS. 7 and 8 show a second embodiment of the invention.

Between its main portion 30 and terminal portion 32, the first hole 14 longitudinally presents an intermediate portion 34 having a larger diameter than both the main portion 30 and the terminal portion 32.

Thus, the first hole 14 presents one (first) shoulder surface 36 at the interface between its main portion 30 and intermediate portion 34, and one (second) shoulder surface 42 at the interface between its intermediate portion 34 and terminal portion 32.

Here, the main portion 30 and the terminal portion 32 of the first hole 14 present substantially equal diameters. For example, the first hole 14 presents a diameter, i.e. nominal diameter, that is substantially constant over its length except along the intermediate portion 34.

Corresponding to the intermediate portion 34 of the first hole 14, the guide tube 10 longitudinally presents an intermediate portion 44 having an external diameter larger than its nominal external diameter, so that the first shoulder surface 36 and the second shoulder surface 42 of the first hole 14 act respectively as abutment surfaces for this intermediate portion 44 of the guide tube 10. And the intermediate portion 34 of the first hole 14 acts as a retaining portion for the guide tube 10.

In such a configuration, the guide tube is prevented from moving in both longitudinal directions, i.e. towards the first terminal face 18 and towards the central bore 8, as well.

In this embodiment, the guide tube may be prestressed, either in longitudinal tension or compression, thanks to the retaining portion.

Prestressing in tension is particularly useful for a straight guide tube 10 for the reasons given hereabove in conjunction with the first embodiment.

Prestressing in compression is particularly useful for a helical guide tube 10 in order to cause the guide tube 10 to lay against the inner surface 12 of the central bore 8 at the median longitudinal portion of the drill pipe 1. Such forcing of the guide tube 10 minimizes pressure drop of the drilling mud in the central bore 8 and prevents damages by tools traveling down the drill string.

Thanks to the second shoulder surface 42, the guide tube 10 is prevented from moving towards any coupling device housed within the groove 28. Damaging of this coupling device is therefore also prevented.

The intermediate (retaining) portion 44 can be made by plastically expanding the guide tube 10 in a radial direction, for example during a dudgeonning operation, as shown in FIG. 7. This is typically made after insertion of a guide tube 10 having a nominal diameter along its entire length into the first hole 14.

A threading, knurling and/or brazing operation can be carried out on the inner surface 34 of the intermediate portion 44 of the first hole 14. This improves the holding of the guide tube 10 in the first hole 14.

FIG. 8 illustrates an exemplary expansion method for forming the intermediate portion 44 of the guide tube 10, by use of an expansion tool 45.

The expansion tool 45 comprises a cylindrical elastomer portion 45A arranged between two metal portions 45B and 45C. Due to forces acting on the metal portions, the cylindrical elastomer portion 45A axially shrinks and radially expands.

When this expansion tool 45 is inserted inside the guide tube 10, at the intermediate portion 44 to be formed, said forces result in the expansion of the guide tube 10 into the retaining portion 34.

As an alternative to this expansion method, chemical products may be used for expanding the guide tube 10 into the retaining portion 34.

The retaining portion 34 may be located near the end of the first hole 14 but does not have to.

Figure 9:
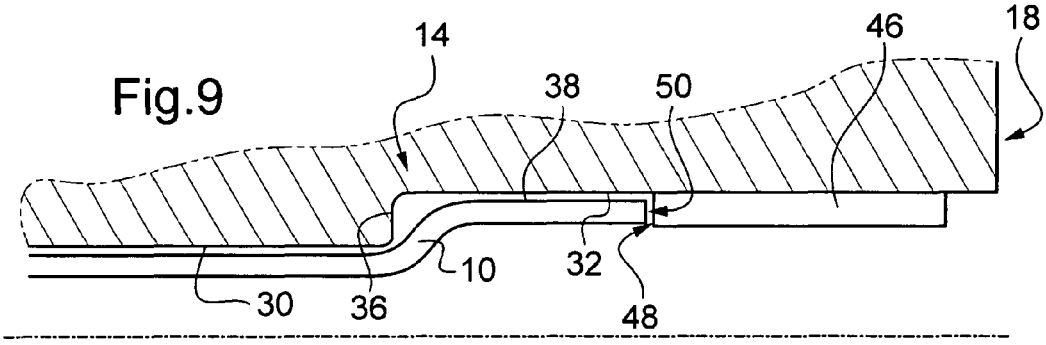
FIG. 9 is a longitudinal sectional view partially showing the connection part of FIG. 5, according to a third embodiment.

FIG. 9 shows a third embodiment of the invention.

The first hole 14 presents a terminal portion 32 having a larger diameter than its main portion 30. Thus, the first hole 14 presents a first shoulder surface 36, which is arranged at the interface between its terminal portion 32 and main portion 30.

The guide tube 10 presents a terminal portion 38 having an external diameter larger than its nominal external diameter for abutment on the first shoulder surface 36. The terminal portion 38 of the guide tube may be manufactured as an expanded longitudinal portion of the guide tube 10.

A stopping member 46 for the guide tube 10 is housed within the terminal portion 32 of the first hole 14. Here, this stopping member 46 forms an abutment surface 48 for an end face 50 of the guide tube 10.

The stopping member 46 may be designed as a hollow and cylindrical part having an external diameter corresponding to the internal diameter of the terminal portion 32 of the first hole 14.

Preferably, the terminal portion 32 of the first hole 14 terminates on the terminal face 18 of the drill pipe 1. In this case, the stopping member 46 could be inserted into the first hole 14 from this terminal surface 18.

The stopping member 46 is fixed in the terminal portion 32 of the first hole 14, at least in the longitudinal direction.

For example, the stopping member 46 is secured by means of a friction coupling between its outer periphery surface and the inner surface of the terminal portion 32 of the first hole 14. This friction coupling could be manufactured by radially and plastically expanding the stopping member 46, for example by dudgeonning.

Alternatively, the stopping member 46 could also be bonded on the inner surface of the terminal portion 32 of the first hole 14.

The length of the stopping member 46 is preferably chosen based on the needed coupling strength. This coupling strength could be evaluated with regard to the expected compression/flexion/tension strength in the drill pipe 1.

In this embodiment, the terminal portion 32 of the first hole 14 acts as a retaining portion for the guide tube 10. The guide tube 10 is prevented from moving in both longitudinal directions, i.e. towards the first terminal face 18 and towards the central bore 8. This allows the guide tube 10 to be longitudinally prestressed in tension or compression.

Figure 10:
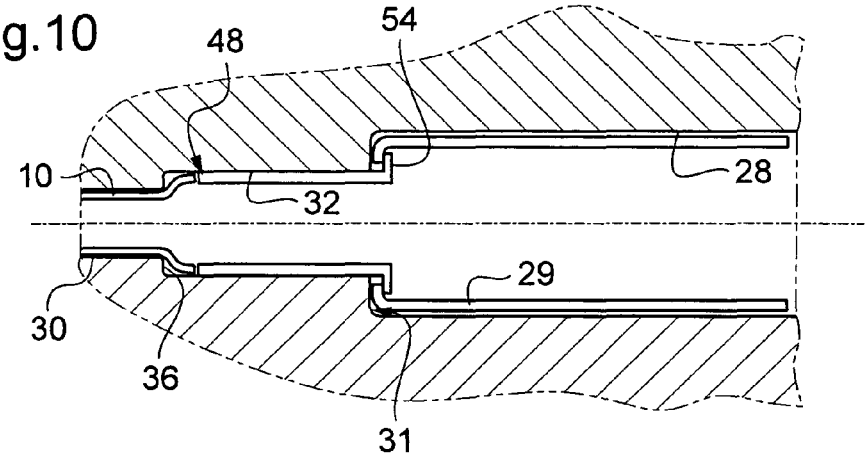
FIG. 10 is analog to FIG. 9, according to an alternative embodiment.

A particular development of this third embodiment is shown in FIG. 10.

Here, the terminal portion 32 of the first hole 14 terminates within the retaining, end annular groove 28.

The stopping member 46 is designed as a securing element for the conductive layer 29 located within the retaining groove 28.

For example, this stopping member 46 comprises a flange 54, or collar, with an external diameter larger than the internal diameter of the terminal portion 32 of the first hole 14, so that the flange 54 secures the conductive layer 29 against the bottom surface 31 of the groove 28 as the stopping member 46 pass through a corresponding opening in the conductive layer 29.

Same could be done with a U-shaped annular MCEI element.

The stopping member 46 can be expanded or bonded to the inner surface of the terminal portion 32 of the first hole 14.

Figure 11:
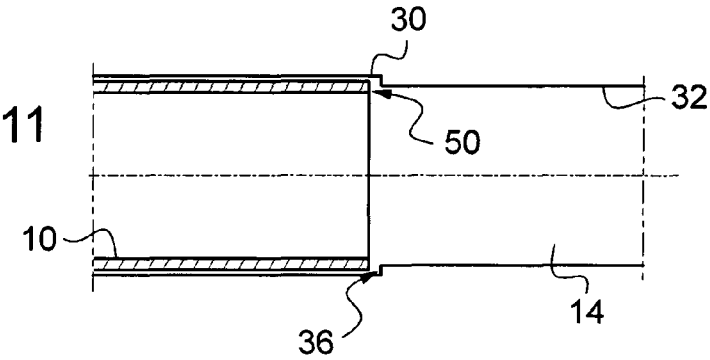
FIG. 11 is analog to FIG. 9 according to a fourth embodiment.

FIG. 11 shows a fourth embodiment of the invention.

The terminal portion 32 of the first hole 14 presents a smaller diameter than the main portion 30. The diameter of the terminal portion 32 is smaller than the nominal external diameter of the guide tube 10.

Thus, the first hole 14 presents a shoulder surface 36 which is located at the interface between its main portion 30 and terminal portion 32.

The shoulder surface 36 acts as an abutment surface for the terminal surface 50 of the guide tube 10.

The guide tube 10 is not housed in the terminal portion 32 of the first hole 14 as the guide tube 10 presents a nominal outer diameter larger than the internal diameter of said terminal portion 32. Here, the guide tube 10 does not need any expanded portion.

In this embodiment, the terminal portion 32 of the first hole 14 acts as a retaining portion for the guide tube 10. The guide tube 10 is prevented from moving in the longitudinal direction towards the first terminal face 18 of the drill pipe 1. This prevents the guide tube 10 from moving and damaging any coupling device located in the groove 28 and/or any electrical connector located between the wires housed in the guide tube 10 and said coupling device. Further, it is possible to prestress the guide tube 10 in longitudinal compression.

Figure 12:
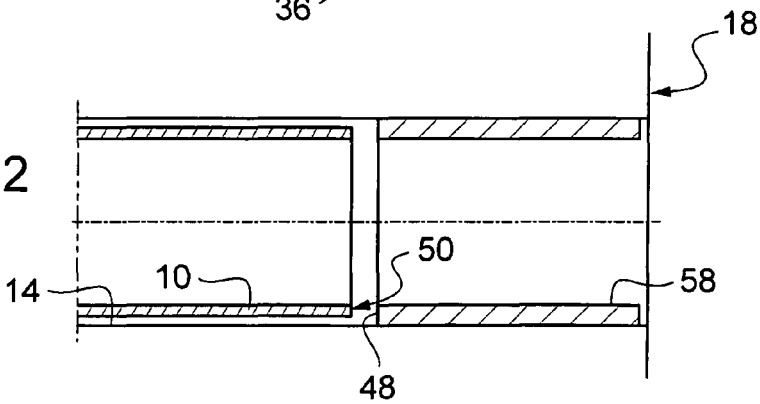
FIG. 12 is analog to FIG. 9 according to a fifth embodiment.

FIG. 12 shows a fifth embodiment of the invention.

The first hole 14 presents a diameter that is substantially constant over its length. That is, the first hole 14 does not have both a main portion 30 and a terminal portion 32, or, in other words, the main portion 30 and the terminal portion 32 present equal diameters.

A stopping member 58, similar to the stopping member 46, is housed within the first hole 14, between the terminal surface 50 of the guide tube 10 and the terminal face 18, or the groove 28, in order to act as an abutment surface for the guide tube 10.

In this embodiment, the guide tube 10 is prevented from moving in the longitudinal direction towards the first terminal face 18 of the drill pipe 1. Further, it is possible to prestress the guide tube 10 in longitudinal compression.

The stopping member 58 may be expanded or bonded to the inner surface of the first hole 14. A friction coupling between the stopping member 58 and the inner surface of the first hole 14 could alternatively be provided.

Figure 13:
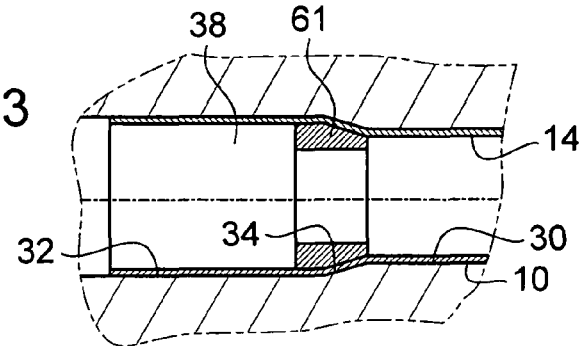
FIG. 13 is analog to FIG. 9 according to a sixth embodiment.

FIG. 13 shows a sixth embodiment of the invention.

The first hole 14 longitudinally presents a main portion 30 and a terminal portion 32 connected to each other through a intermediate portion 34.

The terminal portion 32 of the first hole 14 presents a larger diameter than the main portion 30, at least near this terminal portion 32. The main portion 30 may present the same internal diameter over its entire length, but do not have to.

The intermediate portion 34 of the first hole 14 is designed as a tapered portion connecting the terminal portion 32 to main portion 30.

The guide tube 10 longitudinally presents a terminal portion 38 having a larger diameter than its nominal diameter and an intermediate portion connecting the terminal portion 38 to the rest of the guide tube 10 and corresponding to the intermediate portion 34 of the first hole 14.

The intermediate portion of the guide tube 10 is radially and plastically expanded.

A tapered wedge 61 can be located within the guide tube 10 at the intermediate portion thereof in order to improve holding of the guide tube 10, particularly in a tension tightened state.

The intermediate portion 34 is only optional.

The tapered wedge 61 may be inserted with a relative high rotation speed so as to perform a friction welding.

The tapered wedge 61 is used to manufacture a metal seal between the guide tube 10 and the first hole 14.

Number of tapered wedges 61 can be used at the same time in conjunction with number of longitudinal portions having different diameters at the terminal portion 38 in order to reinforce holding, prestressing and/or the sealing of the guide tube 10.

Figure 14:
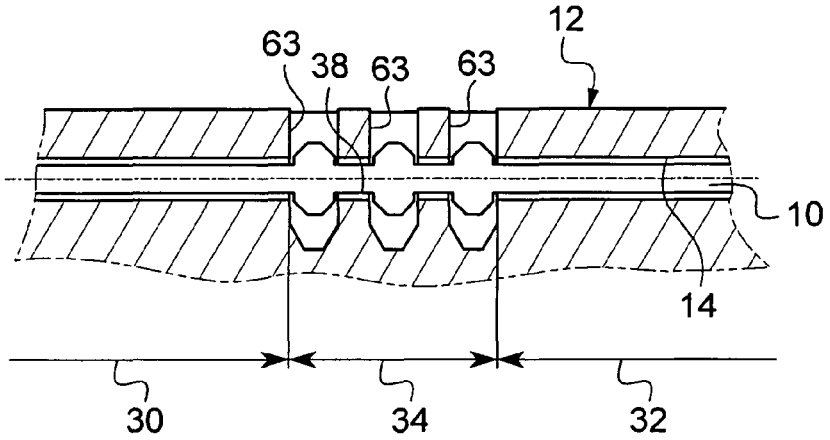
FIG. 14 is analog to FIG. 9 according to a seventh embodiment.

FIG. 14 shows a seventh embodiment of the invention.

The first hole 14 longitudinally present an intermediate portion 34 connecting its terminal portion 32 to its main portion 30. Here, the inner diameter of the terminal portion 32 and the inner diameter of the main portion 30 near the intermediate portion 34 is the same, i.e. nominal diameter of the first hole 14.

This intermediate portion 34 longitudinally presents a number of retaining portions 63 having an inner diameter larger than the rest of the intermediate portion 34, i.e. the nominal diameter of the intermediate portion 34.

Here, the nominal diameter of the intermediate portion 34 and the nominal diameter of the first hole 14 are the same.

The retaining portions 63 are designed as grooves which are radially machined in the inner surface 12 of the central bore 8, for example by turning, slotting or milling.

The guide tube 10 longitudinally presents an intermediate portion connecting its first terminal portion 38 to its main portion. The intermediate portion of the guide tube 10 corresponds to the intermediate portion 34 of the first hole 14. The intermediate portion of the guide tube 10 presents radially and plastically expanded portions corresponding to the retaining portions 63 of the first hole 14.

Optionally, the grooves forming the retaining portions 63 of the first hole 14 may be filled with melted metallic materials or synthetic materials in order to both protect the guide tube 10 and improve the retaining, prestressing and/or sealing of the guide tube 10 within the first hole 14.

Figure 15:
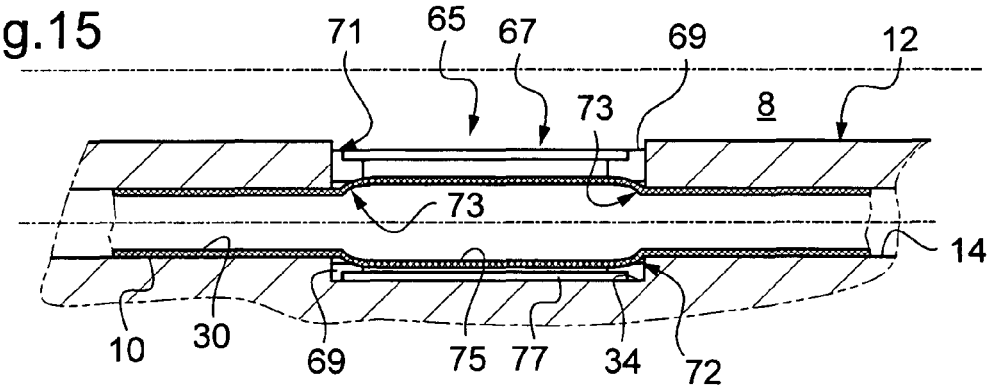
FIG. 15 is analog to FIG. 9 according to an eighth embodiment.

FIG. 15 shows an eighth embodiment of the invention.

The intermediate portion 34 of the first hole 14 presents a pocket 65 which is open on the central bore 8 of the drill pipe 1 and arranged in the inner surface 12 of this central bore 8. Here, the pocket 65 presents a parallelepipedic form, but other forms can be designed, cylindrical for example.

The intermediate portion of the guide tube 10, which corresponds to the intermediate portion 34 of the first hole 14, present a radially and plastically expanded portion 75. A first abutment face 71 for the guide tube 10 is thus arranged at one longitudinal end of the pocket 65 whereas a second abutment face 72 for the guide tube 10 is arranged at the other longitudinal end of the pocket 65.

In other words, the pocket 65 acts as a retaining portion for the guide tube 10, which prevents this guide tube 10 from moving in both longitudinal directions. Further, it is possible to prestress the guide tube 10 in tension or compression.

Optionally, an additional retainer 67 can be used to improve retaining and/or prestressing of the guide tube 10.

An exemplary additional retainer 67 comprises two annular rings 69. Each annular ring 69 abuts on one of the first abutment face 71 and second abutment face 72.

The guide tube 10 passes through each one of the annular rings 69. Each annular ring 69 presents an annular seat surface 73 for the guide tube 10.

Each annular seat surface 73 is designed as a tapered portion which can cooperate with a transition portion of the guide tube 10 which is located between its expanded portion 75 and the rest thereof.

The retainer element 67 may also comprise an external sleeve 77 connecting the annular rings 69 to each other.

Optionally, the gap between the external sleeve 77 and the guide tube 10 can be filled with melted material or with synthetic material for sealing.

Figure 16:
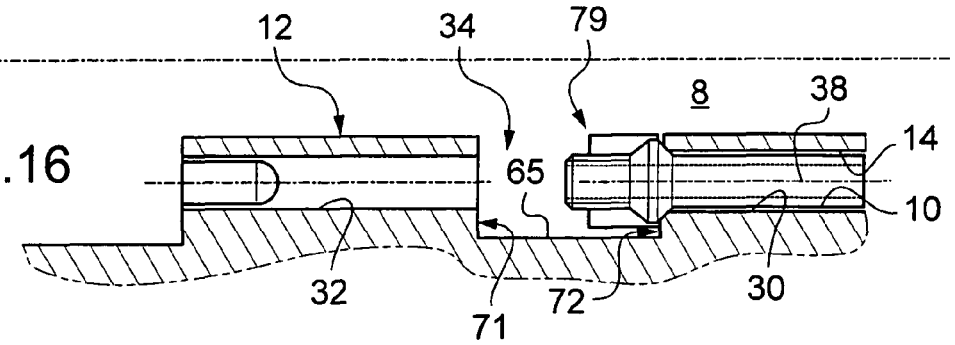
FIG. 16 is analog to FIG. 9 according to a ninth embodiment.

FIG. 16 shows a ninth embodiment of the invention.

As in the eighth embodiment, the intermediate portion 34 of the first hole 14 comprises a pocket 65 which is arranged in the inner surface 12 of the central bore 8.

Here, the first terminal portion 38 of the guide tube 10 is housed in the main portion 30 of the first hole 14, near the pocket 65.

A mechanical retainer 79 is located within the pocket 65 to maintain the guide tube 10, for example in a tension tightened state.

An exemplary mechanical retainer 79 is a screw/nut system.

The nut of said screw/nut system applies against the one of the first abutment face 71 and the second abutment face 72 that is near the main portion 30 of the first hole 14. The screw of the screw/nut system applies a tension stress to the guide tube 10.

Alternatively, the mechanical retainer element 79 may be designed as an extensor.

Optionally, the pocket 65 may be protected by a sleeve.

FIG. 17 shows a tenth embodiment of the invention.

Here, the first hole 14 is, at least partially, designed as a groove arranged in the inner surface 12 of the central bore 8.

The guide tube 10 is housed within said groove and fixed to the inner surface thereof, for example by welding.

The guide tube may be fixed in a longitudinal prestressed state, in tension or in compression.

The groove terminates on the first terminal face 18 of the main pipe 2.

FIG. 18 shows an eleventh embodiment of the invention.

The main portion of the first hole 14 is designed as a groove 81 which is arranged in the inner surface 12 of the central bore 8 and is typically longitudinal.

The first hole 14 longitudinally presents an intermediate portion connecting its main portion and terminal portion 32 to each other. The intermediate portion of the first hole 14 is designed as a pocket 85 arranged in the inner surface 12 of the central bore 8.

Here, the terminal portion 32 of the first hole 14 terminates within the end groove 28.

The main portion of the guide tube 10 is housed within the main, longitudinally grooved, portion 81 and fixed to the internal surface thereof, at least partially, for example by welding. The guide tube 10 can be retained in a tension or compression prestressed state. The pocket 85 may be protected by a sleeve.

The groove section can be flat, for example manufactured by milling, or round, for example machined by turning.

The terminal portion 32 of the first hole 14 can be machined by a deep drilling, for example gun drilling, operation from the coupler groove 28.

As an alternative embodiment, no pocket is arranged between the groove 81 of the first hole 14 and the terminal portion 32 of this first hole 14.

The guide tube 10 may further be hold within the terminal portion 32 of the first hole 14, for example by swaging or welding.

In case that the groove presents a circular shape, which is concentric to the central bore 8, the groove 81 can be machined by back-boring.

FIG. 19 shows a twelfth embodiment of the invention.

The first terminal portion 38 of the guide tube 10 is held in the terminal portion 32 of the first hole 14.

The first terminal portion 38 of the guide tube 10 comprises a flange part 91 which forms an abutment surface for the guide tube 10. The flange part 91 prevents the guide tube 10 from moving in the longitudinal direction towards the second connection part 6. The guide tube 10 may be retained in a longitudinal prestressed (tension) state.

The flange part 91 can be welded on the first terminal face 18 of the drill pipe, further enabling longitudinal prestressing of the guide tube in compression. In this embodiment, stainless steels are preferably used.

Optionally, mechanical components may be used in order to increase the performance of the welding, for example a wedge inserted within the guide tube 10.

According to the embodiments described above, the guide tube 10 is prevented from moving in the longitudinal direction towards the central bore 8 and/or towards the first 18 or second 20 terminal face of the drill pipe 1. This results in that the guide tube 10 undergoes longitudinal stresses of compression and/or tension. In other words, tension, compression and/or bending loads exerted on the drill pipe 1 result in compression and/or tension stresses in the guide tube 10.

Thanks to the retaining means, at least some of the stress in the main tube results a corresponding stress of the guide tube 10, which has to be resisted by a suitable design of the retaining means.

When the guide tube 10 is sealed to the first connection part 4 and to the second connection part 6, which could provided in conjunction with most of the embodiments here above, the guide tube 10 has in addition to undergo the mud pressure on its outer surface, specially for the portion the guide tube which is not housed in one of the first hole 14 and the second hole 16.

When the guide tube 10 is not sealed to the first connection part 4 and to the second connection part 6, roughly the same pressure will be exerted on both the inner and outer surfaces of the guide tube 10. This results in that the guide tube 10 does not have to undergo the mud pressure in this case.

Figure 22:
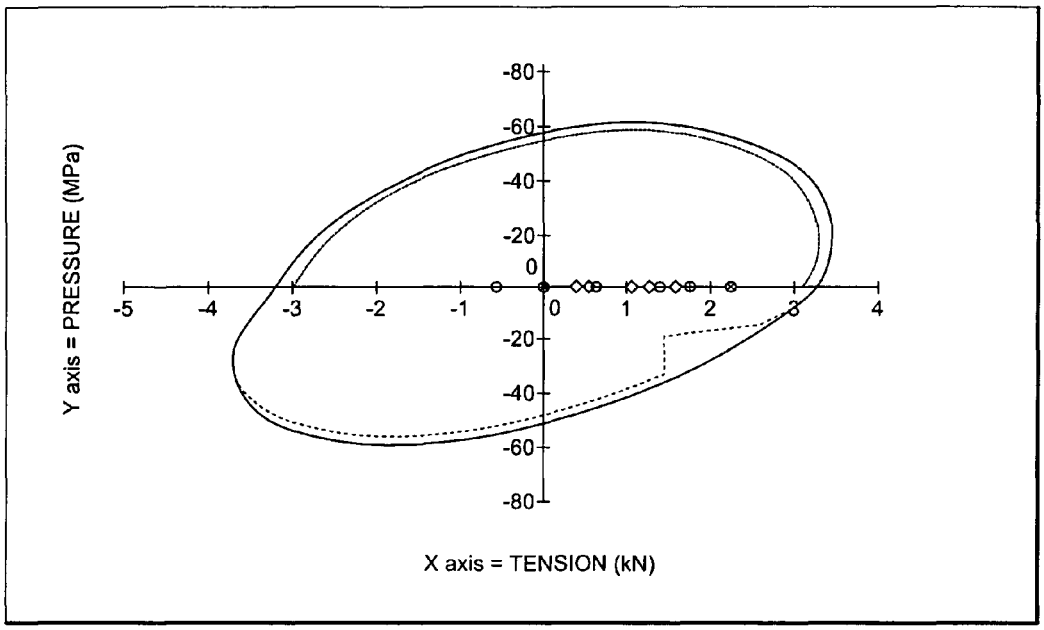
FIG. 22 is a diagram showing the stresses undergone by an unsealed guide tube retained in tension compared to its limit curve.

FIG. 22 represents the resulting stresses undergone by the guide tube 10 respectively when a low differential pressure is exerted on it. The tension and compression loads are put in abscissas (positive for tension) and the differential pressure in ordinates (positive for inner pressure). The limit curve for yielding of the guide tube 10 is also shown on FIG. 22. The limit curve presents an ellipse shape according to Von Mises equivalent stress theory.

Figure 23:
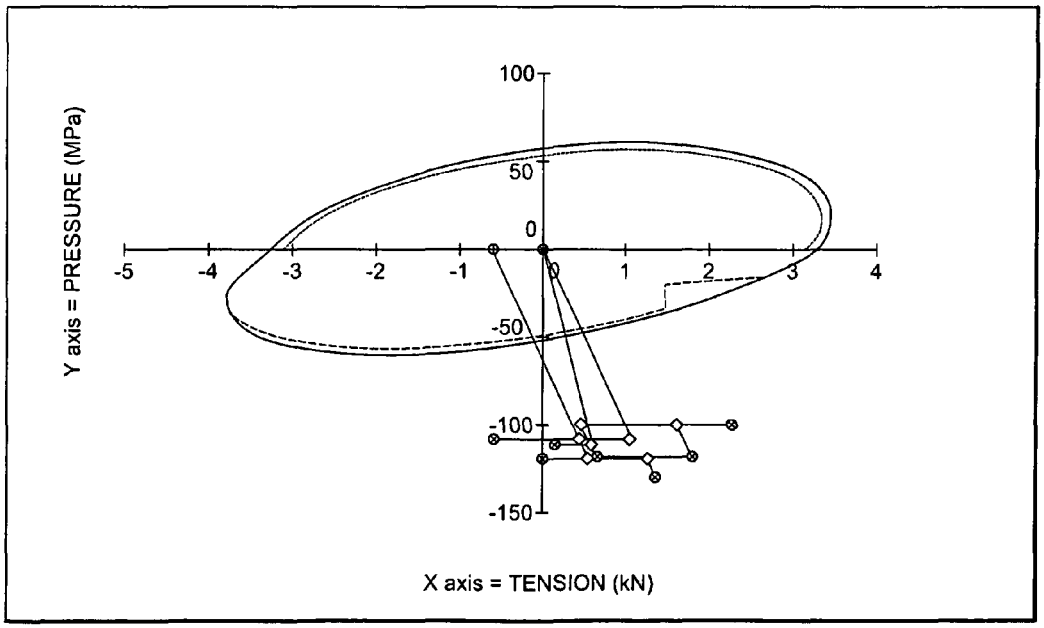
FIG. 23 is analog to FIG. 22 for a sealed guide tube.

FIG. 23 is analog to FIG. 22 for high differential pressures.

In both cases, the guide tube has been prestressed in longitudinal tension before being submitted to the drill pipe service loads and mud pressure.

In FIG. 22, the stress representative points lie on the abscissas axis: no differential pressure across the guide tube. The stress representative points are inside the ellipse of Von Mises.

In FIG. 23, the stress representative points may locate outside the ellipse of Von Mises, i.e. there is a risk of rupture of the guide tube 10.

In case of high differential pressure, it can be necessary to upgrade material of the guide tube 10, for example from low carbon steel (yield stress of 235 MPA) to Inconel 825 (yield stress of 1000 MPA).

FIG. 20 shows a thirteenth embodiment of the invention.

The guide tube 10 is held, preferably at both sides of the pipes, according to one of the foregoing embodiments. Thus, the guide tube 10 is prevented from moving according to both longitudinal directions. Preferably, the guide tube 10 is maintained in a tension as indicated by the arrows 95.

The guide tube 10 houses an additional guide tube 93 which is intended to house the data transmitting wires.

The additional guide tube 93 is neither held nor retained at its ends, so that it is free to move according to both longitudinal directions within the guide tube 10, which is held with respect to the first 4 and second 6 connection ends.

Here, the guide tube 10 is maintained, or retained, by any of the herebefore disclosed means without sealing, so that the mud pressure acts on the additional guide tube 93, as indicated by the thick arrows in FIG. 20.

The additional guide tube 93 is arranged in such a manner that it is tight to the mud thanks to a sealing system 94. The sealing system 94 may be a resilient seal ring in elastomeric material.

This results in uncoupling the pressure and bending influences, as the bending stresses mainly acts on the guide tube 10 whereas the mud pressure acts on the additional guide tube 93.

This results in an easier design of the wired drill pipe 1: the dimensions and material of the guide tube 10 are selected in such a manner that the guide tube 10 resists to axial stresses (tension and compression) whereas the dimensions and material of the additional guide tube 93 are only selected in such a manner that the additional guide tube 93 resists to collapse by the mud pressure. In other words, the guide tube 10 and the additional guide tube 93 can be optimized separately.

Optionally, the guide tube 10 can be provided with holes to be certain that the guide tube 10 is submitted to low differential pressure between its outer and inner surface.

As a variation to the embodiment of FIG. 20, the additional guide tube 93 and the contained wires can be manufactured as a unique coaxial armored cable.

FIG. 21 shows a further alternative embodiment.

Here, the guide tube 10 houses the data transmitting wires and is maintained, or retained, at both ends of the drill pipe 1, as indicated by the arrows 98 by means of one of the above disclosed embodiments.

The guide tube 10 is housed in an additional sheath 96 which is free to move with respect to the drill pipe 1 in both the longitudinal directions. The additional sheath 96 undergoes the external (mud) pressure and resist to the latter thanks to the sealing system 97. This results in that the guide tube 10 does not undergo this external pressure This alternative embodiment also enables the uncoupling of longitudinal loads and mud pressure effects on the wire protection system.

In the above disclosed embodiment, retaining means are provided in the first hole 14 which prevent the guide tube 10 from moving in one or both longitudinal directions.

The second hole 16 may in turn include any one of the retaining means disclosed above. Preferably, the same retaining means are provided in both the first hole 14 and the second hole 16 as similar manufacturing operation can be carried out at the first connection part 4 and the second connection part 6.

For very particular applications, the second hole 16 may also not include any retaining means.

The guide tube 10 is prevented from moving in longitudinal direction which is important when the drill pipe is bent or axially compressed or extended.

In drill pipes in which the guide tube 10 (generally straightly extending along the central bore) is bonded to the inner surface of the central bore, and/or embedded in a coating layer, the invention allows to retain (prestress) the guide tube in tension before applying the bonding means or the coating layer to force the guide tube extend against the main tube internal surface. Any load on the main pipe 2, in particular compression and/or tension, will thus result in a corresponding stress in the guide tube 10 which will be lower than in the case of a free guide tube (not bonded to the main tube internal surface), making design of the retaining means less critical.

The invention also prevents that any compression of the drill pipe results in damaging the conductive layer or other means of the coupling device within groove 28, or any other conductive element, via the end of the guide tube 10.

In drill pipes in which the guide tube extends straightly along the central bore and is not bonded to the inner surface of the central bore 8, the guide tube 10 is pre-stressed (tensioned) in order to prevent any protruding of the guide tube 10 in the central bore and/or any damage on the conductive layer 29, in case of compression of the guide tube, and/or of bending thereof. The invention can also be used to provide the guide tube 10 with said pre-stress.

In the case of a helically extending guide tube, a compression prestressing would be more suitable to force the guide tube against the central bore 8 of main pipe 2.

In some of the above-disclosed embodiments, the retaining means secure the guide tube in the first hole, particularly when a friction coupling is used. It will be understood that such a securing is not necessary to obtain some of the advantages of the invention.

While the invention has been described with respect to a limited number of embodiments, those skilled in the art, having benefit of this disclosure, will appreciate that other embodiments can be devised which do not depart from the scope of the invention. For example:

The end of the guide tube may be located at any longitudinally position inside the first/second hole.

The first/second hole may have a more complex pattern than it has been described, either generally (the hole may extend in a manner which is not parallel to the central bore axis) or precisely (the hole may have a number of adjacent portions from the central bore 8 to the annular groove 28) see for example French patent application FR 08/05376.

The first/second hole may terminate at another location than in the annular groove 28, which is to be considered as optional, see also for example French patent application FR 08/05376.

The guide tube could extend in the central bore 8 following different pattern.

A protective layer may be applied on the guide tube on the internal surface of the central bore 8. Different bonding means could be alternatively used, such as welding or adhesive bonding.

The first hole 14 and the second hole 16, and respectively the first end 22 of the guide tube 10 and the second end 24 of the guide tube 10 may be arranged according to different embodiments as disclosed above.

The invention is not restricted to a drill pipe but may also be applied to a heavy weight drill pipe, a drill collar or any other drill string component.

The invention claimed is:

1. A drill string element comprising:

a main pipe with connection ends and a protective means for at least one wire, the protective means extending within a central bore of the main pipe, the main pipe presenting a first hole in one of the connection ends and a second hole in the other connection end, both holes communicating with the central bore, wherein the protective means comprises a guide tube arranged for housing the wire, both ends of the guide tube being respectively disposed within the first hole and the second hole, retaining means being arranged in at least one of the first hole and the second hole for the respective end of the guide tube, and the retaining means configured to prevent the respective end of the guide tube from moving relative to the one of the first hole and the second hole according to at least one longitudinal direction of the hole, wherein the guide tube houses an additional guide tube housing the at least one wire and includes communication means for mud between guide tube outer and inner peripheral surfaces and the additional guide tube is arranged such that the additional guide tube is free to move with respect to the guide tube in the longitudinal direction thereof.

2. A drill string element according to claim 1, wherein the retaining means is arranged to prevent the guide tube from moving in both longitudinal directions of the hole.

3. A drill string element according to claim 1, wherein the retaining means comprises at least one abutment surface for the guide tube, the abutment surface extending radially in the hole.

4. A drill string element according to claim 3, wherein the abutment surface cooperates with a radial end surface of the guide tube.

5. A drill string element according to claim 3, wherein the at least one abutment surface cooperates with a radially expanded portion of the guide tube.

6. A drill string element according to claim 3, wherein the at least one abutment surface is arranged as a shoulder surface of the hole.

7. A drill string element according to claim 3, wherein the at least one abutment surface is arranged as an end surface of an additional member located within the hole, fixing means being provided in the hole, which prevent the additional member from any longitudinal displacement relative to the hole.

8. A drill string element according to claim 7, wherein the fixing means for the additional member comprises a friction coupling between an outer surface of the additional member and an inner surface the hole.

9. A drill string element according to claim 8, wherein the friction coupling is derived from a diameter expansion of the additional member.

10. A drill string element according to claim 7, wherein the hole terminates in a bottom surface of an annular groove, which is configured to receive a corresponding annular element of a coupling device for transmitting signals to another drill string element, the additional member being arranged as a fixing element for the corresponding annular element which passes through an opening in the annular element.

11. A drill string element according to claim 3, wherein the at least one abutment surface is configured as an internal surface of an additional member, through which the guide passes.

12. A drill string element according to claim 11, wherein the additional member is located within an internal hollowing which is open on the central bore, the hole passing through or terminating in the internal hollowing.

13. A drill string element according to claim 1, wherein the retaining means comprises at least one retaining portion of the hole in a form of a longitudinal portion of the hole having cross-sectional dimensions larger than a main portion of the hole.

14. A drill string element according to claim 13, wherein the retaining portion cooperates with a radially expanded portion of the guide tube.

15. A drill string element according to claim 13, wherein the retaining portion comprises at least one hollowing which is open on the central bore and has a depth larger than the diameter of the main portion of the hole.

16. A drill string element according to claim 15, wherein the at least one hollowing is filled with metallic or synthetic material.

17. A drill string element according to claim 12, wherein fixing means for the guide tube are provided within the hollowing.

18. A drill string element according to claim 17, wherein the fixing means comprises a screw/nut retainer cooperating with one longitudinal end of the guide tube.

19. A drill string element according to claim 1, wherein the retaining means comprises a friction coupling arranged between the inner surface of a longitudinal portion of the hole and an outer surface of a longitudinal portion of the guide tube.

20. A drill string element according to claim 1, wherein the hole comprises a longitudinal portion which is formed as a longitudinal groove open on an internal surface of the central bore.

21. A drill string element according to claim 1, wherein the hole terminates on a terminal face of the corresponding connection end and the guide tube presents a longitudinal terminal portion which is designed as a flange abutting on the terminal face.

22. A drill string element according to claim 1, wherein the retaining means creates a seal between the guide tube and the corresponding connection end.

23. A drill string element according to claim 1, wherein the guide tube is held in a prestressed state, in longitudinal tension or compression.

24. A drill string element comprising:

a main pipe with connection ends and a protective means for at least one wire, the protective means extending within a central bore of the main pipe, the main pipe presenting a first hole in one of the connection ends and a second hole in the other connection end, both holes communicating with the central bore, wherein the protective means comprises a guide tube arranged for housing the wire, both ends of the guide tube being respectively disposed within the first hole and the second hole, retaining means being arranged in at least one of the first hole and the second hole for the respective end of the guide tube, and the retaining means configured to prevent the respective end of the guide tube from moving relative to the one of the first hole and the second hole according to at least one longitudinal direction of the hole, wherein the guide tube is housed in a tubular sheath which is sealed to the connection ends and arranged such that the tubular sheath is free to move with respect to the connection ends.

* * * * *

UNITED STATES PATENT AND TRADEMARK OFFICE

CERTIFICATE OF CORRECTION

PATENT NO. : 9,200,486 B2
APPLICATION NO. : 13/259735
DATED : December 1, 2015
INVENTOR(S) : Gerard Leveau et al.

It is certified that error appears in the above-identified patent and that said Letters Patent is hereby corrected as shown below:

Specification
Column 6, line 23, change "the second hole presents" to --the second hole 16 presents--.

Signed and Sealed this
Twenty-sixth Day of July, 2016

Michelle K. Lee

Michelle K. Lee
*Director of the United States Patent and Trademark Office*